US006627852B1

(12) United States Patent
Savone

(10) Patent No.: US 6,627,852 B1
(45) Date of Patent: Sep. 30, 2003

(54) CURLING IRON WITH ROTATABLE ASYMMETRICAL HEATING TIPS

(76) Inventor: Umberto Savone, 1046 N. Orlando Ave., Los Angeles, CA (US) 90069

( * ) Notice: Subject to any disclaimer, the term of this patent is extended or adjusted under 35 U.S.C. 154(b) by 11 days.

(21) Appl. No.: 10/246,142

(22) Filed: Sep. 18, 2002

(51) Int. Cl.[7] ..... A45D 1/04

(52) U.S. Cl. ..... 219/225; 132/237; 132/232; 219/524

(58) Field of Search ..... 219/225, 226, 219/222, 533, 524; 132/224–241, 269

(56) References Cited

U.S. PATENT DOCUMENTS 4,267,431 A * 5/1981 Rick et al. ..... 219/225
4,479,047 A * 10/1984 Khaja et al. ..... 219/225
4,533,819 A * 8/1985 Valiulis ..... 219/225
4,591,695 A * 5/1986 Inoue ..... 219/225
4,604,514 A * 8/1986 Thaler et al. ..... 219/225

FOREIGN PATENT DOCUMENTS

DE 2718187 * 8/1978

* cited by examiner

*Primary Examiner*—John A. Jeffery
(74) *Attorney, Agent, or Firm*—Blakely Sokoloff Taylor & Zafman

(57) ABSTRACT

A curling iron is provided having two handles coupled to two heating tips having non-symmetrical cross-sectional shapes with respect to their lengthwise axes. At least one of the heating tips is rotatably coupled to its handle to rotate along an axis lengthwise along the handle. Thus, by rotating the heating tips about axes along the handle length to orient the heating tip cross-sectional shapes with respect to each other so that various heating tip contact surfaces are selected, the curling iron can be used to (1) curl hair to different curl shapes and tightness, and (2) straighten or flatten hair. Each curling iron handle may also include demountable heating tip and power cord couplings so that wires in the handle can be demountably connected to various heating tips, and can be demountably connected to an electrical power cord for powering the heating element coupled to that handle.

25 Claims, 4 Drawing Sheets

CURLING IRON WITH ROTATABLE ASYMMETRICAL HEATING TIPS

BACKGROUND

1. Field

The invention relates to curling irons, and in particular, to an improved curling iron having rotatable heating tips to adjust the shape of a hair contact surface between the heating tips.

2. Background

Heated curling irons are commonly used to style hair to a wide variety of styles, such as by curling hair to impart a curl that does not occur naturally occur in the hair, and by straightening hair to remove a kink or curl that does naturally occur in that hair. For example, a circular or semicircular-shaped curl can be created by wrapping hair about the outer surface of a heated cylindrically shaped curling iron tip. In addition, to straighten hair, heated flat iron tips can be pressed together to flatten wavy or curly hair. Moreover, it is often desirable when styling hair to both add curl to certain portions of hair, and straightening other portions of hair. In addition, it is also sometimes desirable when styling hair to first straightening a portion of hair to remove the hair's natural curl and then to re-curl the straightened hair to the desired shape.

However, in order to style hair by both straightening and curling, generally, at least two irons are required. One iron is needed to straighten portions of the hair, and another curling iron is needed to curl portions of the hair, because current curling iron technology does not provide an adequate single tool for sufficiently and interchangeably straightening hair and curling hair. Therefore, what is needed is an effective and efficient iron for alternating between straightening hair and curling hair while styling hair.

SUMMARY

A curling iron is provided having two handles coupled to two heating tips having non-symmetrical cross-sectional shapes with respect to their lengthwise axes. At least one of the heating tips is rotatably coupled to its handle to rotate along an axis lengthwise along the handle. Thus, by rotating the heating tips about axes along the handle length to orient the heating tip cross-sectional shapes with respect to each other so that various heating tip contact surfaces are selected, the curling iron can be used to (1) curl hair to different curl shapes and tightness, and (2) straighten or flatten hair.

For instance, embodiments include a generally oval-shaped first heating tip cross-section and a generally crescent-shaped second heating tip cross-section so that hair can be styled by (1) separating or pivoting the two heating tips of the curling iron away from each other, (2) closing the heating tips onto a portion of hair to press the hair in a contact surface between a first heating tip generally convex curve cross-section and a second heating tip generally concave curve cross-section, (3) separating the heating tips to release the portion of hair after the desired curl is achieved, (4) rotating the first heating tip about the handle axis so that a second different generally convex curve of the first heating tip is rotated towards the second heating tip, and (5) re-closing the heating tips on a portion of hair to press the hair in a different contact surface formed by contact between a second different generally convex curve of the rotated first heating tip and the second heating tip generally concave curve.

In addition, embodiments include generally flat shaped portions of the first and second heating tip cross-sections so that hair can be styled by (1) pressing hair between a first heating tip first generally convex curve and a second heating tip generally concave curve, (2) separating the heating tips to release the portion of hair curled, (3) rotating the first heating tip around a first rotational axis lengthwise along the first handle length so that a first generally flat portion of the first heating tip cross-section is rotated towards the second heating tip, (4) rotating the second heating tip around a second axis along the second handle length so that a second generally flat portion of the second heating tip cross-section is rotated towards the first heating tip, and (5) closing the heating tips on a portion of hair to flatten or straighten the hair by pressing the hair between the generally flat cross-sectional shape of the first heating tip and the generally flat cross-sectional shape of the second heating tip.

Moreover, embodiments of the invention include removable or demountable heating tip and power cord couplings to curling iron handles. For instance, the invention includes wires in the first and second handles with detachable connectors for demountably connecting to various heating tips having heating elements powered through the wires. Furthermore, the wires in the first and second handles can each have a demountable connector for connection to an electrical power cord which provides the power for the heating element attached to that handle.

BRIEF DESCRIPTION OF THE DRAWINGS

The invention is illustrated by way of example and not by way of limitation in the figures of the accompanying drawings in which like references indicate similar elements. It should be noted that the references to "an" or "one" embodiment of this disclosure are not necessarily to the same embodiment, and such references mean at least one.

DETAILED DESCRIPTION

According to embodiments of the invention, a curling iron is provided having two handles coupled to two heating tips having non-symmetrical cross-sectional shapes with respect to their lengthwise axes. At least one of the heating tips is rotatably coupled to its handle to rotate along an axis lengthwise along the handle. By rotating the heating tips about axes along the handle length to orient the heating tip cross-sectional shapes with respect to each other, various heating tip contact surfaces can be selected for curling hair to different curl shapes and curl "tightness" (e.g., curl "tightness" refers to the radial size of a curl or a general maximum circumference to contain the curl's shape). In addition, by rotating the heating tips with respect to each other along the handle axes, the heating tips cross-sectional shapes of some embodiments can be oriented to provide various contact surfaces for curling hair when rotated to certain orientations, and can also be rotated to provide a generally flat contact surface for flattening hair when rotated to another orientation.

Moreover, embodiments of the invention include heating tips and power cords that can be removably or demountably coupled for connection to and release from curling iron handles. Therefore, the invention can include wires in the first and second handles with detachable connectors for demountably connecting to various heating tips having heating elements powered through the wires, and for demountably connecting to a power cord which provides the power for the heating element. For instance, heating elements in the first and second heating tips may be powered through two sets of wires running from the elements through the first and second handles to detachable connections to two sets of power cords. Thus, the invention provides an adequate, effective, and efficient single iron for sufficiently and interchangeably alternating between straightening hair and curling hair, while styling hair.

Figure 1:
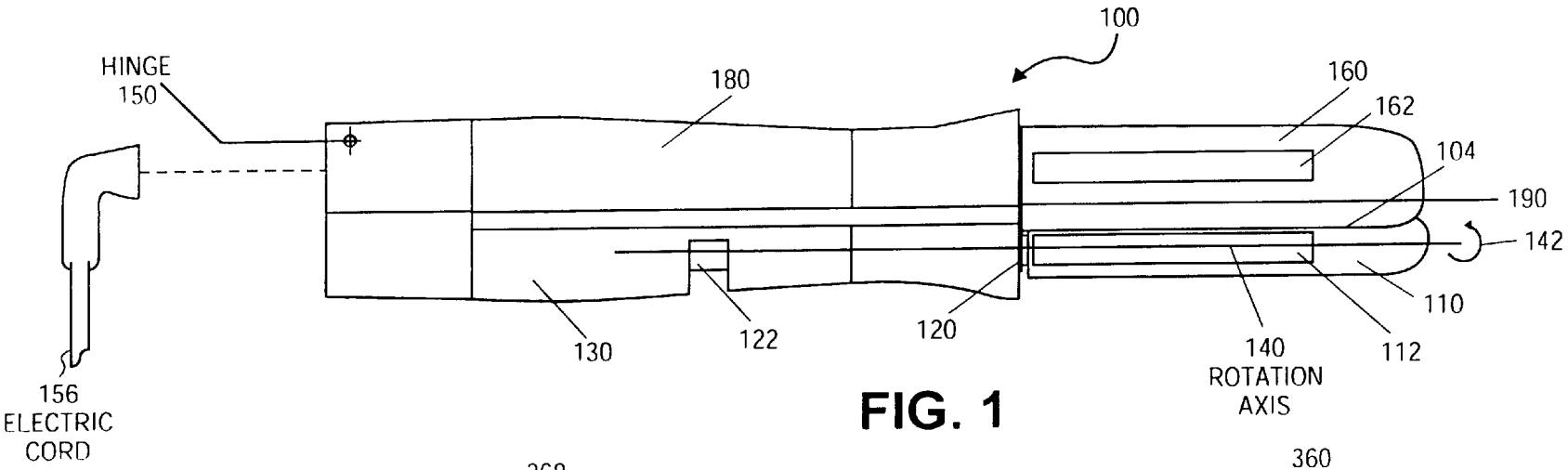
FIG. 1 illustrates a side perspective view of a curling iron having a first rotatable coupling, according to one embodiment of the invention.

Embodiments of the curling iron technology described herein may be applied to various other hair treating or styling devices for shaping hair, such as, curlers, brushes, clamp curling brushes, steam curlers, hair rollers, hot hair rollers, hair straighteners, hair flatteners, and curling wands. For example, FIG. 1 illustrates a side perspective view of a curling iron having a first rotatable coupling, according to one embodiment of the invention. As shown in FIG. 1, a curling iron, generally denoted 100, includes first heating tip 110 having first heating element 112, and second heating tip 160 having second heating element 162. First rotatable coupling 120 couples the proximate end of first handle 130 to the proximate end of first heating tip 110, having a first rotational axis 140 lengthwise along the first handle to rotate the first heating tip to a first rotational angle 142. Note that first rotational axis 140 may have various other rotational axes in order to provide for desired contact surfaces between the heating tips, such as, an axis running lengthwise along the handle, an axis along the length of the heating tip, and an axis along a contact surface formed between the heating tips.

Also, as shown in FIG. 1, second coupling 170 couples a proximate end of second handle 180 to a proximate end of second heating tip 160. Moreover, hinge 150 pivotally couples the distal end of first handle 110 to the distal end of second handle 160 so that the handles may be pivoted away from each other to an open position where first heating tip 110 is spaced apart or separated from second heating tip 160. Hinge 150 also allows first handle 130 and second handle 180 to be pivoted towards each other to a closed position when first heating tip 110 contacts second heating tip 160 or presses a portion of hair along contact surface 190.

Figure 2:
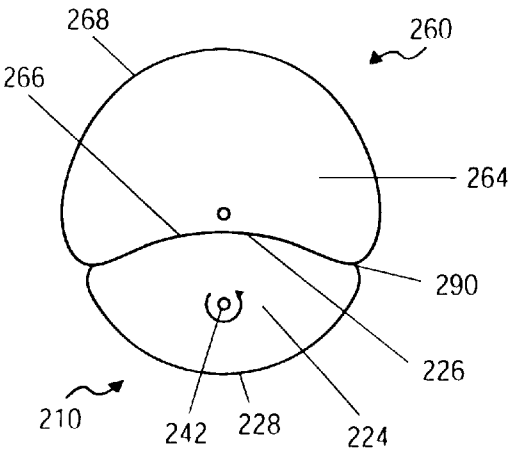
FIG. 2 is a front perspective view of a curling iron first and second heating tips showing a contact surface formed by a first heating tip generally convex curve contacting a second heating tip generally concave curve, according to one embodiment of the invention.

Embodiments of the invention include heating tips having non-symmetrical cross-sectional shapes with respect to an axis running lengthwise along the tip, or lengthwise along a contact surface formed between the heating tips. For example, FIG. 2 is a front perspective view of a curling iron first and second heating tips showing a contact surface formed by a first heating tip generally convex curve contacting a second heating tip generally concave curve, according to one embodiment of the invention. As shown in FIG. 2, first heating tip 210 has generally oval-shaped cross-section 224 formed by joining first generally convex curve 226 with second different generally convex curve 228. Also, second heating tip 260 has generally crescent-shaped cross-section 264 formed by generally circular curve 268 intersected with generally concave curve 266. Thus, when heating tips 210 and 260 are closed towards each other, they form contact surface 290 which may be a surface defined by contact between first generally convex curve 226 and second heating tip generally concave curve 266. In this example, heating tip 210 has a rotational axis (e.g., see axis 140 of FIG. 1) for which first rotational angle 242 is on the order of zero degrees (i.e. 0° ) as illustrated in FIG. 2. In addition, the invention contemplates various other appropriate non-symmetrical shapes for heating tip cross-section shapes 224 and 264, such as cross-sectional shapes including a portion of one or more of a semi-circle, an ellipse intersected with a line, a circle, a polygon, an oval, an ellipse, a trapezoid, a square, a quadrilateral, a rectangle, a closed curve, a convex curve, a concave curve, and a polyhedron.

Figure 3:
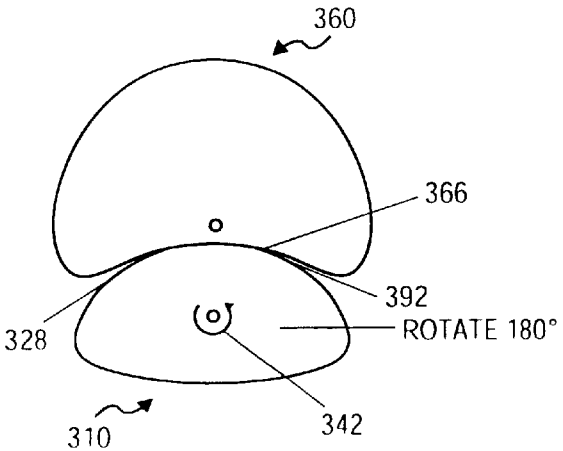
FIG. 3 is a front perspective view of a curling iron heating tips showing a contact surface formed by a first heating tip second differently convex curve contacting the second heating tip generally concave curve, according to one embodiment of the invention.

Embodiment of the invention include rotating one or more of the heating tips along an axis as described above with respect to axis 140 of FIG. 1 to rotational angles in the range of 0° to 360°. For example, FIG. 3 is a front perspective view of a curling iron heating tips showing a contact surface formed by a first heating tip second differently convex curve contacting the second heating tip generally concave curve, according to one embodiment of the invention. As shown in FIG. 3, contact surface 392 is formed by contact between first heating tip second different generally convex curve 328 and second heating tip generally concave curve 366 when first rotational angle 242 is rotated on the order of 180° forming first rotational angle 342. Thus, when heating tip 310 contacts heating tip 360 as illustrated in FIG. 3 hair pressed between the two heating tips is curled according to a different contact surface than that shown in FIG. 2. Although FIGS. 2 and 3 show contact surfaces formed by generally convex curves contacting a generally concave curve, various other contact surfaces are considered, such as those formed by contact between cross-sectional shapes including any of those described above with respect to cross-sectional shapes 224 and 264 of FIG. 2. Note that the term "press" "pressed" or "pressing" as used herein and basically describe closing the heating tips of the curling iron together to form an inside or anterior contact surface between the heating tips where the tips address, press together, sandwich, or apply a force to the hair between the heating tips.

Figure 4:
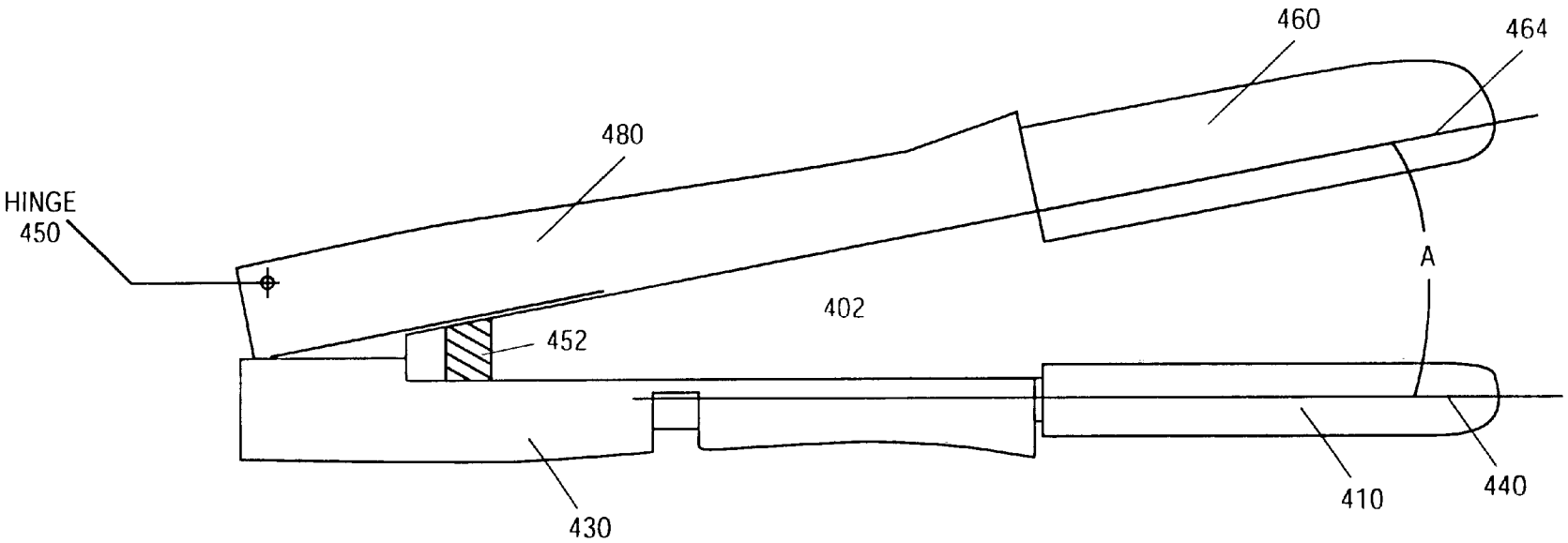
FIG. 4 is a side perspective view of a curling iron showing a hinge and spring for allowing a second handle and heating tip to pivot away from the first handle and heating tip, according to one embodiment of the invention.

According to embodiments of the invention, various systems and devices may be used to provide for opening and closing of the curling iron such that the heating tips are spaced apart or separated from each other and can then be brought together to press hair with a contact surface formed between the heating tips when closed about the hair. For example, FIG. 4 is a side perspective view of a curling iron showing a hinge and spring for allowing a second handle and heating tip to pivot away from the first handle and heating tip, according to one embodiment of the invention. As shown in FIG. 4, hinge 450 allows second handle 480 and second heating tip 460 to pivot away from first handle 430 and first heating tip 410 to form angle A between first rotational axis 440 and axis 464 lengthwise along an anterior surface of second handle 480. Although Angle A as shown in FIG. 4 is approximately 10°, Angle A may be in the range of between 0° and 180° (e.g., 0° when closed and 5° to 25° when open). In addition, FIG. 4 shows spring 452 to pivotally push first handle 430 and second handle 480 apart from a closed position (e.g., see closed position 104 of FIG. 1) to open position 402. Although in FIG. 4 a spring is shown to assist in opening or pivoting the handles apart from each other, various other devices and systems may be used, such as a coil, a torsion bar, a compression device (e.g., such as a piece of rubber, a piece of foam, and a piece of plastic), a tension device, a counter-spring, a hinge, a plastic device, pulleys, gears, and various other devices, materials and systems to provide a separating force. Moreover, alternate hinge positions may be used to allow second handle 480 and second heating tip 460 to pivot away from first handle 430 and first heating tip 410, such as by locating a hinge proximate to where handles 430 and 480 meet, such as where axis 464 intersects the base of second handle 480.

In addition, embodiments of the invention provide a method for styling hair by curling the hair with various contact surfaces provided by heating tips of a single curling iron. For example, first heating element 112 may be heated, such as by using electrical power, to heat first heating tip 110 of curling iron 100, while second heating element 162 is heated to heat second heating tip 160 of the curling iron. Once the heating tips are appropriately heated, they may be spaced apart or separated, such as shown at open position 402 and a portion of hair to be curled may be then inserted between the heating tips. The heating tips may then be closed to closed-position 104 contacting the portion of hair between first heating tip 110 and second heating tip 160 with first contact surface 290 which is a surface defined by contact between first heating tip first generally convex curve 226 and second heating tip generally concave curve 266. Note that in this example, first heating tip 210 and second heating tip 260 have generally oval-shaped cross-section 224 and generally crescent-shaped cross-section 264, respectively, as described above in FIG. 2.

Next, the portion of hair to be curled by first contact surface 290 is sufficiently heated, the heating tips can again be separated (e.g., see open position 402 of FIG. 4), and first heating tip 110 rotated to change first rotational angle 142 to change the contact surface for curling hair. Hence, the same portion of hair curled with first contact surface 290 above can be re-pressed with a separate contact surface, or, another portion of hair can be pressed by a separate contact surface, where the separate contact surface is described below.

For instance, first heating tip 110 is rotated 142 from first rotational angle 242 of 0° to first rotational angle 342 of 180° around first rotational axis 140 lengthwise along first heating tip 310. Thus, first heating tip second different generally convex curve 328 is rotated towards second heating tip 360. After this adjustment, the heating tips are then again closed to press a portion of hair contacted (e.g., see closed position 104 of FIG. 1) between first heating tip and second tip second contact surface 392 formed by contact between first heating tip second different generally convex curve 328 and second heating tip generally concave curve 366. In this way, the invention provides an adequate, effective, and efficient single iron for sufficiently and interchangeably alternating between various contact surfaces for curling hair with different curling shapes and curl tightness according to how the heating tips are rotated or oriented with respect to each other.

Furthermore, embodiments of the invention include various devices or systems for rotating the heating tips. For instance, as shown in FIG. 1, first rotatable coupling 120 can have a first lever 122 at the first handle 130 to adjust first rotational angle 142 of the first heating tip. Note that various other devices or systems for lever 122 may be used to cause rotation of the heating tips, such as engaging devices for engaging the heating tip or an attachment thereto (e.g., see shaft 536 of FIG. 5) including a tab, a flange, a rotating wheel, a switch, a flange, a disc, a wedge, a screw, a bolt, a nut, and a key.

Figure 5:
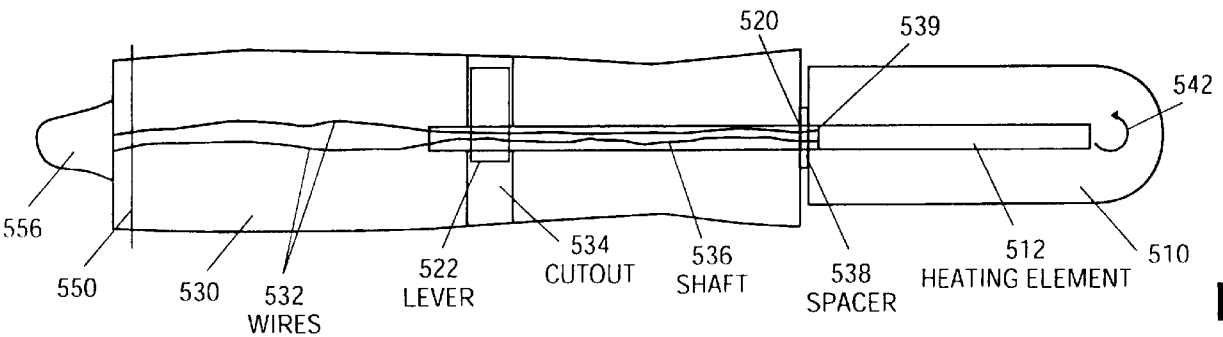
FIG. 5 is a top perspective cross-section of a curling iron first handle and heating tip showing the wires, lever, lever cut-out, shaft, spacer, and heating element, according to one embodiment of the invention.

For example, FIG. 5 is a top perspective cross-section of a curling iron first handle and heating tip showing the wires, lever, lever cut-out, shaft, spacer, and heating element, according to one embodiment of the invention. As shown in FIG. 5, first rotatable coupling 520 for coupling heating tip 510 to handle 530 can include first cut-out 534 to allow first lever 522 to move to adjust first rotational angle 542 of heating tip 510 via first shaft 536 which translates the first lever adjustment to the first heating tip. In addition, FIG. 5 shows first spacer 538 to space first handle 530 from first heating tip 510, first attachment 539 to attach first shaft 536 to first heating tip 512, and axis 550 of hinge 150. Lever 522 provides a device for rotating heating tip 510 first rotational angle 542 to various degrees. For example, first lever 522 may be used to adjust first rotational angle 542 to an angle in the range between 0° and 180°. Note that various other orientations may be used as well to rotate one or both heating tips to create a desired contact surface, such as rotational angles of 5°, 10°, 20°, 45°, 90°, 180°, and any combination thereof. FIG. 5 also shows first heating element 512 coupled to first wire or wires 532 to provide electrical power to first heating element 512. In turn, wires 532 may be coupled to electrical power cord 556. Note that the structure as shown in FIG. 5 may also be used to provide the second heating tip, second handle, and second structure of the curling iron for use with the structure shown in FIG. 5 in order to provide a curling iron having two rotatable heating tips.

Moreover, according to embodiments, wire or wires for providing electrical power to both heating elements in both heating tips may be separately disposed within the handles and separately connected to an electrical power cord for providing electrical power (e.g., such as from a wall outlet), or may be separately connected to another electronic device, and/or may be electronically connected in parallel series in order to provide electronic power to heating tip heating elements. For instance, referring to FIG. 5, electric power cord 556 may be connected to first wire or wires 532 via first handle 530, and electric power cord 556 may also be coupled to a second wire or wires via a second handle for providing electronic power to a second heating element, respectfully.

In addition to the electric power cord connection as shown in FIG. 5 (e.g., electric power cord 556 connection to first wire or wires 532, and heating tip coupling 520), embodiments of the invention include removable or demountable heating tip and power cord couplings to curling iron handles. For instance, embodiments include separate power connection at each handle for providing electrical power to each heating element. Thus, each separate power connection may be coupled to a single separate power cord, or may share a power cord with another power connection. Moreover, power cord connections contemplated include removable or demountable power connections that can be attached when power cord(s) are connected to the power connection(s) and released when the power cord(s) are removed. In this way, the demountable electrical power connections can provide translation of electrical power from each power cord to each of one or more power connections for powering one or more heating elements of the heating tips. Note that herein, the terms "removable" "detachable" and "demountable" are used interchangeably to describe couplings, attachments, and connections that are designed to be connected and released without damaging components of the invention.

For example, as shown in FIG. 1, a demountable electrical power cord connections can be used to connect power electric power cord 156 to second handle 180 to provide electricity to heating element 162, while a separate demountable electrical power cord connections may be used to connect a separate power electric power cord (not shown) to first handle 130 to provide electricity to heating element 112. Hence, demountable electrical power cord connections used to connect power electric power cord 156 to second handle 180 may include a coupling similar to a typical two prong wall plug, male/female power connection, and similar to the male/female adapters used to connect headphones to the headphone jack of a stereo, cell phone, or portable sound devices (e.g., a female receptacle having one or more electronic power connections at different depths within the sleeve may be coupled to a shaft having separated heights for receiving distinct electrical power or signals).

Also, as shown in FIG. 5, first wire or wires 532 may be a plurality of wires disposed within first shaft 536 and may be coupled through a rotating device or bearing which is able to provide electrical translation of electrical power to one or more wires independent of the rotation or rotational angle of the heating tip. For example, an electrical coupling between power cord 556 and wires 532 or along wires 532 and handle 530, or along shaft 536, or at spacer 538, or at attachment 539 may include a coupling similar to the male/female adapters used to connect headphones to the headphone jack of a stereo, cell phone, or portable sound device. More specifically, a female receptacle having one or more electronic power connections at different depths within the sleeve may be coupled to a shaft having separated heights for receiving distinct electrical power or signals. Although FIG. 5 shows wires 532 disposed within shaft 536 and attached to heating element 512, first attachment 539, various other systems, connectors, attachments, electrical circuitry, electrical devices for providing or working with the functionality of wires 532 may be used to heat heating tips 510 or provide electrical power to heating element 512.

Figure 6:
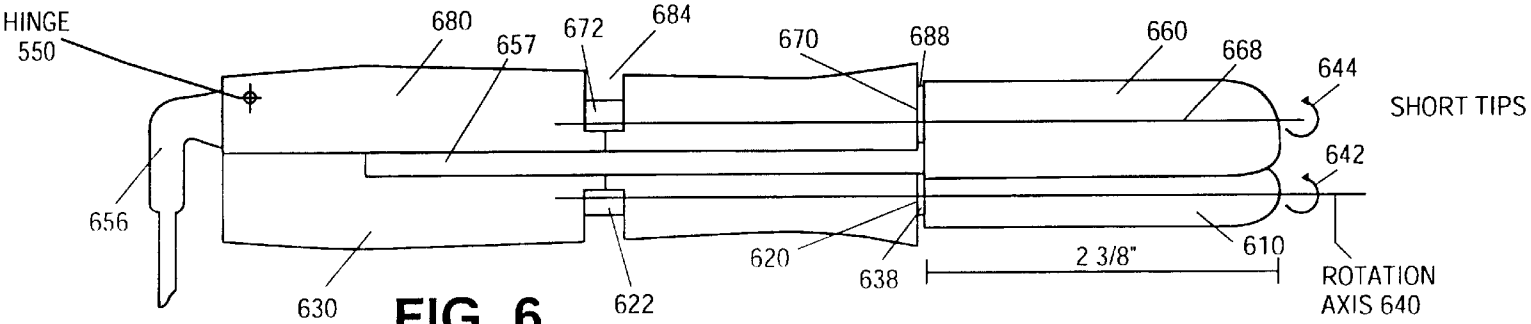
FIG. 6 is a side perspective view of a curling iron having two rotatable couplings and levers for rotating the first heating tip about a first axis and for rotating the second heating tip about a second axis, according to one embodiment of the invention.

As mentioned above, embodiments of the invention may also have a structure similar to that of FIG. 5 to provide a second rotatable heating tip rotatably coupled to the second handle, as well as various other structures and systems to provide a second rotatable heating tip for use with a first heating tip and handle as shown in FIG. 5. For example, FIG. 6 is a side perspective view of a curling iron having two rotatable couplings and levers for rotating the first heating tip about a first axis and for rotating the second heating tip about a second axis, according to one embodiment of the invention. FIG. 6 shows second rotatable coupling 670 having second rotational axis 668 lengthwise along second handle 680 to rotate second heating tip 660 to second rotational angle 644. In addition, second rotatable coupling 670 include second lever 672 at second handle 680 to adjust second rotational angle 644 of second heating tip 660. For instance, second lever 672 may be adjusted or moved in second cutout 684 to change second rotational angle 644 to an angle in the range between 0° and 180°, as described above with respect to angle 542 in FIG. 5. FIG. 6 also shows first heating tip 610 rotatably coupled to first handle 630 via rotatable coupling 620 having first lever 622, spacer 638, for rotating about rotational axis 640 to a first rotational angle 642. Moreover, the curling iron of FIG. 6 has hinge 650 and power cord 656, and anterior gap space 657 between a first anterior surface of first handle 630 and a second anterior surface of second handle 680 when first heating tip 610 and second heating tip 660 contact each other in the closed position.

As shown in FIG. 6, second cut out 684 may have a shape to prohibit second lever 672 from rotating heating tip 660 to second rotational angles 644 beyond certain desired rotational orientations. For instance, when second lever 672 is adjusted all the way to one maximum of cut-out 684, that orientation may be defined as 0°, and when second lever 672 is then rotated or adjusted to another maximum or orientation provided by second cut-out 684, that position may define a second rotational angle 644 at 180° with respect to the 0° orientation. Note that various other positions and orientations may be provided for and defined for adjusting the rotational angle of the first and second heating tip. For example, a lever cut-out may be marked at different locations with different orientation identification markings corresponding to different rotational angles of the heating tips. Also, levers may include orientation settings that can be felt, such as by the lever "clicking" as it rotates into or through selected orientations. Moreover, similar other methods as known in the art of rotational systems and actuation or adjustment thereof can be used to allow a user to distinguish or identify rotational angles or rotational angle settings during adjustment or rotation of the heating tips.

Figure 7:
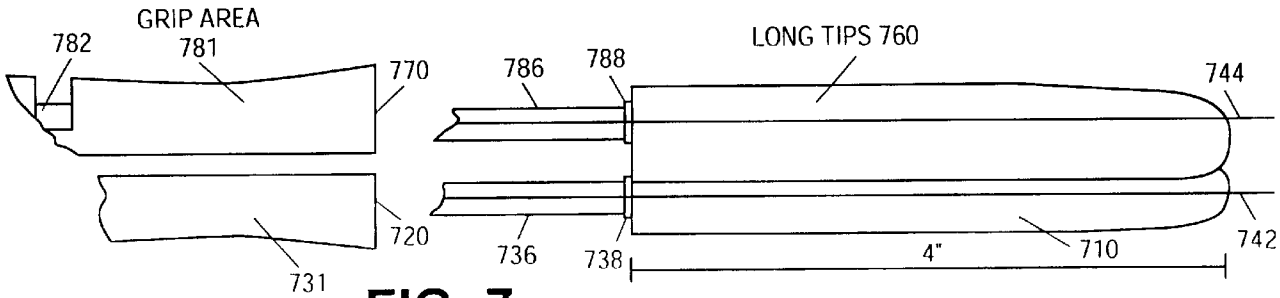
FIG. 7 is a side perspective view of curling iron handles, demountable couplings, and removable heating tips showing handle grips and exchangeable different length heating tips for use with the curling iron, according to one embodiment of the invention.

Embodiments of the invention also include demountable couplings and demountable rotatable couplings for coupling heating tips to handles. For example, FIG. 7 is a side perspective view of curling iron handles, demountable couplings, and removable heating tips showing handle grips and exchangeable different length heating tips for use with the curling iron, according to one embodiment of the invention. As shown in FIG. 7, first demountable coupling 720 is used to attach and release first heating tip 710 to and from first handle 731, and second demountable coupling 770 is used to attach and release second heating tip 760 to and from second handle 781. Thus, first demountable coupling 720 and/or second demountable coupling 770 may be fixed couplings such as described above with respect to second coupling 170 of FIG. 1, and/or rotational couplings such as described above with respect to coupling 120 of FIG. 1 and rotatable coupling 520 of FIG. 5.

Additionally, FIG. 7 shows second lever 782 which may be coupled to second shaft 786 to translate adjustments made with second lever 782 to second heating tip 760. Second spacer 788 spaces second handle 781 from second heating tip 760. Similarly, first shaft 736 is attached to first heating tip 710 which is spaced from the first handle by first spacer 738. Moreover, FIG. 7 shows first gripped area 731 on the posterior of the first handle and second gripped area 781 on the posterior of the second handle away from the contact surfaces for gripping the handles to manipulate the heating tips into the open and closed position, as well as to press together, sandwich, or apply a force between the heating tips along the contact surface.

Therefore, embodiments of the curling iron may include different lengths heating tips that may be attached to and released from the curling iron handles as described above and which may have various cross-sectional shapes, various lengths, various heating capabilities, various surface materials, and various functions for providing desired curling and/or flattening. For instance, the shorter more "snub-nosed" heating tips shown in FIG. 6 at heating tips 610 and 660 which are 2⅜" long may be replaced by longer more slender heating tips 710 and 760 of FIG. 7 which are 4" long, such as by sliding heating tips 610 and 660 out from handles 630 and 680 and replacing them with tips 710 and 760 by sliding shafts 736 and 786 into the first and second handles at demountable coupling positions, such as those provided at couplings 720 and 770. Note that different length heating tips for attaching and releasing from the handles at demountable couplings may include demountable coupling technology having various connectors or systems such as those including a hole, a shaft, a flanged enclosure, a sleeve, threads, a clamp, a keeper, a key, a lock, a latch, snap-in fasteners, and various other locking and/or releasable attachments for attaching and releasing tips from the handles. For instance, heating tips having lengths range between 1 inch and 7 inches may be demountably coupled to handles by sliding heating tip shafts (e.g., shafts 736 and 786) into handle sleeves which engage the shafts and provide electrical connection for heating tip heating element power (e.g., as described above with respect to electrical coupling of wires 532 of FIG. 5).

Moreover, according to embodiments, demountable couplings may include demountable electrical power connections that can be attached when heating tips are attached to handles and released when the heating tips are removed. In this way, the demountable electrical power connections can provide translation of electrical power from one or more wires in the handles to one or more heating elements of the heating tips. For example, a demountable electrical power connection between demountable coupling 720 and shaft 736 may include a coupling similar to the male/female adapters used to connect headphones to the headphone jack of a stereo, cell phone, or portable sound device as described above with respect to electrical coupling of wires 532 of FIG. 5.

Figure 8:
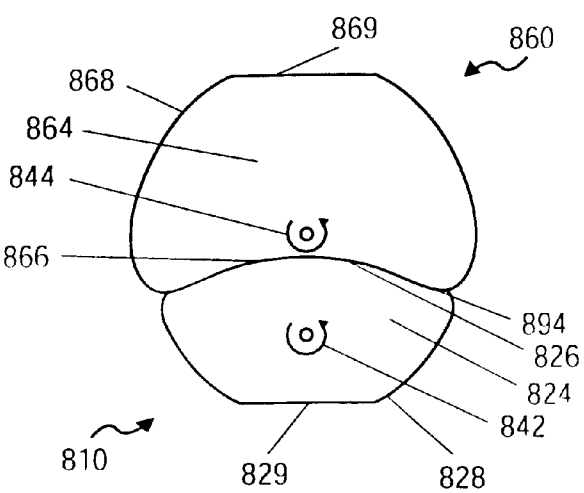
FIG. 8 is a front perspective view of two curling iron heating tips showing a contact surface formed by a first heating tip generally convex curve contacting a second heating tip generally concave curve, according to one embodiment of the invention.

Furthermore, embodiments of the invention include heating tips having generally flat cross-sectional shaped portions in addition to the cross-sectional shaped portion that provides for curling, so that hair can be curled by pressing it between the cross-sectional portion that provides for curling, and then the heating tips can be rotated along a lengthwise axis with respect to the handles and tips and closed on a portion of hair to provide a generally flat cross-sectional contact surface for straightening or flattening hair. For example, FIG. 8 is a front perspective view of two curling iron heating tips showing a contact surface formed by a first heating tip generally convex curve contacting a second heating tip generally concave curve, according to one embodiment of the invention. As shown in FIG. 8, first heating tip 810 has a generally oval-shaped cross-section 824 formed by joining first generally convex curve 826 with second different generally convex curve 828 and joined with first generally flat cross-sectional shape 829 which is located opposite from first generally convex curve 826. Also, second heating tip 860 has generally crescent-shaped cross-section 864 formed by generally circular curve 868 intersected with generally concave curve 866 and having second generally flat cross-sectional shape 869 located opposite from generally concave curve 866. Thus, the structure shown in FIG. 8 allows hair to be curled by closing tips 810 and 860 upon a portion of hair to provide contact surface 894 defined by contact between first heating tip first generally convex curve 826 and second heating tip generally concave curve 866. In addition, various other cross-sectional shapes and contact surfaces are contemplated as described above with respect to heating tips 210, 260, 310, and 360; contact surfaces 290 and 392; and cross-sectional shapes 224 and 264 of FIGS. 2 and 3 as described above.

Figure 9:
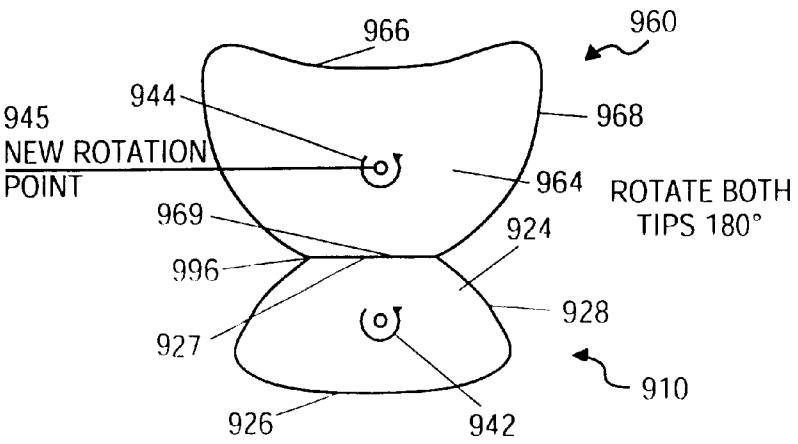
FIG. 9 is a front perspective view of two curling iron heating tips showing a contact surface formed by a first heating tip generally flat surface contacting a second heating tip generally flat surface, according to one embodiment of the invention.

By rotating heating tips 810 and 860 of FIG. 8, a contact surface can be provided for flattening or straightening hair. For example, FIG. 9 is a front perspective view of two curling iron heating tips showing a contact surface formed by a first heating tip generally flat surface contacting a second heating tip generally flat surface, according to one embodiment of the invention. As shown in FIG. 9, generally flat contact surface 996 is provided having a surface defined by contact between first generally flat cross-sectional shape 929 and second generally flat cross-sectional shape 969. Thus, for example, by rotating tip 810 to first rotational angle 942 on the order of 180° in rotation from first rotational angle 842, and by rotating second heating tip 860 to second rotational angle 944 on the order of 180° in rotation from second rotational angle 844, a generally flat contact surface 996 can then be used to flatten or straighten hair.

According to embodiments, heating tips can be rotated to rotational angles while the tips are in the closed or open position. Further, embodiments include rotating heating tips to rotational angles (e.g., see 142, 242, 342, 542, 642, 644, 842, 844, 942, and 944) about various axes running lengthwise with respect to the handles and/or heating tips (e.g., see 140, 440, 640, 668, 742, 744, and 945) in order to provide contact surfaces desired (e.g., see 290, 392, 894, and 996). For instance, a second heating tip may rotate about an axis as shown in FIG. 8, to second rotational angle 844, or may rotate about a new rotational point or axis 945 as shown in FIG. 9, to second rotational angle 944.

In addition, embodiments of the invention provide a method for styling hair by curling the hair, as well as straightening the hair, with various contact surfaces provided by heating tips of a single curling iron. For example, first heating element 112 may be heated, such as electronically, to heat first heating tip 110 of curling iron 100, while second heating element 162 is heated to heat second heating tip 160 of the curling iron. Once the heating tips are appropriately heated, they may be separated by pivoting first heating tip 110 away from second heating tip 160 to an open position, such as shown at open position 402. A portion of hair to be curled may be then inserted between the heating tips. First handle 130 rotatably coupled to first heating tip 110 can then be pivoted towards second handle 180 rotatably coupled to second heating tip 160 to close the heating tips to closed position 104 and cause the heating tips to contact the portion of hair to be curled. Closed heating tips contact the portion of hair between first heating tip 810 and second heating tip 860 with first contact surface 894 which is a surface defined by contact between first heating tip first generally convex curve 826 and second heating tip generally concave curve 286. Note that in this example, first heating tip 810 and second heating tip 860 have a generally oval-shaped cross-section 824 and generally crescent-shaped cross-section 864, respectively, as described above in FIG.

8. Next, the portion of hair to be curled by first contact surface 894 is sufficiently heated and the heating tips can again be separated (e.g., see open position 402 of FIG. 4).

Then, first heating tip 810 can be rotated to change first rotational angle 842, and second heating tip 860 can be rotated to change second rotational angle 844, to change the contact surface from a surface for curling hair (e.g., see contact surface 894) to a surface for straightening or flattening hair (e.g., see contact surface 996 of FIG. 9). Hence, the same portion of hair curled with a first curling contact surface can be re-pressed with a separate flattening contact surface, or, another portion of hair can be pressed by a separate flattening contact surface.

For instance, first lever 622 is adjusted to rotate first heating tip 810 from first rotational angle 842 of 0° around first rotational axis 640 lengthwise along first handle 630 to first rotational angle 942 of 180°. Likewise, second lever 672 is adjusted to rotate second heating tip 860 from second rotational angle 844 of 0° around second rotational axis 668 lengthwise along second handle 680 to second rotational angle 944 of 180°. Thus, first heating tip first generally flat cross-sectional shape 829 is rotated towards second heating tip 860, and second heating tip second generally flat cross-sectional shape 869 is rotated towards first heating tip 810.

After the first and second lever adjustments, the heating tips can then be pivoted towards one another again and closed to press a portion of hair to be straightened (e.g., see closed position 104 of FIG. 1). Closed heating tips contact the portion of hair between first heating tip 910 and second heating tip 960 with second contact surface 996 which is a surface defined by contact between first heating tip first generally flat cross-sectional shape 829 and second heating tip second generally flat cross-sectional shape 869. In this way, the invention provides an adequate, effective, and efficient single iron for sufficiently and interchangeably alternating between various contact surfaces for curling hair with different curling shapes and curl tightness, and flattening or straightening hair, according to how the heating tips are rotated or oriented with respect to each other.

In one embodiment, the curling iron device has a total length on the order of 190 millimeters ("mm") in magnitude of length, handles on the order of 120 mm of magnitude in length, and heating tips on the order of 70 mm in magnitude of length. Furthermore, each handle may have a lever and/or cut-out on the order of approximately 65 mm in magnitude of length from the base of the handle (e.g., for instance 65 mm from the end of the handle where the hinge is located). In addition, the lever and cut-out may be on the order of approximately 8 mm in width.

Moreover, according to embodiments, when in the closed position the two handles closed together have a radius between 25 mm and 30 mm and the two heating tips closed together have a radius of approximately 25 mm. In addition, the generally oval shaped cross-section of the first heating tip is on the order of 10.3 mm from the midpoint of the first generally convex curve to the midpoint of the second different generally convex curve through the axis (e.g., first rotational axis 140 or first rotational angle 242) and approximately 50 mm between the two points where the first generally convex curve joins the second different generally convex curve (e.g., edges of contact surface 290). Also, the second different generally convex curve of the first heating tip may have a radius on the order of magnitude of approximately 26 mm in length.

Similarly, in an embodiment, the generally crescent shaped cross-section of the second heating tip has a generally circular curve having a radius on the order of 26 mm and is intersected with a generally concave curve at approximately 16.3 mm from the midpoint of the generally circular curve through the axis (e.g., second rotational axis 668 or second rotational angle 844) and approximately 50 mm between the two points where the generally circular curve is intersected with the generally concave curve (e.g., edges of contact surface 290). Likewise, the generally flat cross-sectional shapes of the first heating tip (e.g., first generally flat cross-sectional shape 829 or second rotational angle 844) and second heating tip (e.g., second generally flat cross-sectional shape 869) of embodiments may be the order of magnitude of approximately 20 mm in length (e.g., edges of contact surface 996).

Components, handles, grips, tips, levers, cut-outs, shafts, spacers, electronics components and circuitry, heating elements, and other parts of curling iron embodiments contemplated by the invention include fabrication by various methods and with various materials such as forging, casting, injection molding, milling, carving, fastening, shaping, depositing, etching, doping, and forming from various materials including metals, plastics, wood, cork, rubber, titanium, aluminum, stainless steel, alloy, composite, porcelain, resin, epoxy, semi-conductor materials, and various other appropriate materials.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than restrictive sense.

What is claimed is:

1. A curling iron comprising:

a first heating tip having a first heating element;

a second heating tip having a second heating element;

a first rotatable coupling to couple a proximate end of a first handle to a proximate end of said first heating tip, wherein said first rotatable coupling includes a first rotational axis lengthwise along said first handle to rotate said first heating tip to a first rotational angle;

a second coupling to couple a proximate end of a second handle to a proximate end of said second heating tip; and a hinge to pivotally couple a distal end of said first handle to a distal end of said second handle to define an open position when said first heating tip is spaced apart from said second heating tip, and a closed position when said first heating tip contacts said second heating tip along a contact surface.

2. The curling iron of claim 1, wherein said first heating tip further comprises a generally oval shaped cross-section formed by joining a first generally convex curve with a second different generally convex curve, and wherein said second heating tip further comprises a generally crescent shaped cross-section formed by a generally circular curve intersected with a generally concave curve.

3. The curling iron of claim 2, wherein said contact surface comprises a surface defined by contact between said first heating tip first generally convex curve and said second heating tip generally concave curve formed when said first rotational angle is on the order of 0 degrees.

4. The curling iron of claim 2, wherein said contact surface comprises a surface defined by contact between said first heating tip second different generally convex curve and said second heating tip generally concave curve when said first rotational angle is on the order of 180 degrees.

5. The curling iron of claim 1, wherein said first rotatable coupling comprises a first lever at said first handle to adjust said first rotational angle of said first heating tip.

6. The curling iron of claim 5, wherein said first heating element is coupled to a first wire to provide electrical power to said first heating element;

wherein said second heating element is coupled to a second wire to provide electrical power to said second heating element.

7. The curling iron of claim 6, further comprising an electric power cord for coupling to said first wire and said second wire via said first handle and said second handle respectively.

8. The curling iron of claim 5, wherein said first rotatable coupling comprises a first cutout to allow said first lever to adjust said first rotational angle, a first shaft to translate said first lever adjustment to said first heating tip, a first spacer to space said first handle from said first heating tip, and a first attachment to attach said first shaft to said first heating tip.

9. The curling iron of claim 8, wherein said first wire comprises at least one wire disposed within'said first shaft.

10. The curling iron of claim 5, wherein said first rotational angle is an angle in a range of between 0 degrees and 180 degrees.

11. The curling iron of claim 1, wherein said hinge allows said second handle and said second heating tip to pivot away from said first handle and said first heating tip to form an angle between said first rotational axis and an axis lengthwise along an anterior surface of said second handle.

12. The curling iron of claim 11, wherein said angle between said first rotational axis and an axis lengthwise along an anterior surface of said second handle is an angle in a range between 0 degrees and 25 degrees.

13. The curling iron of claim 1, further comprising a spring to pivotally push said first handle and said second handle apart from said closed position.

14. The curling iron of claim 1, wherein said second coupling comprises a second rotatable coupling including a second rotational axis lengthwise along said second handle to rotate said second heating tip to a second rotational angle.

15. The curling iron of claim 14, wherein said first heating tip comprises a generally oval shaped cross-section formed by joining a first generally convex curve with a second different generally convex curve and a first generally flat cross-sectional shape opposite from said first generally convex curve, and wherein said second heating tip comprises a generally crescent shaped cross-section formed by a generally circular curve intersected with a generally concave curve and a second generally flat cross-sectional shape opposite from said generally concave curve.

16. The curling iron of claim 15, wherein said contact surface comprises a surface defined by contact between said first generally flat cross-sectional shape and said second generally flat cross-sectional shape formed when said first rotational angle is on the order of 180 degrees and said second rotational angle is on the order of 180 degrees.

17. The curling iron of claim 14, wherein said second rotatable coupling comprises a second lever at said second handle to adjust said second rotational angle of said second heating tip.

18. The curling iron of claim 17, wherein said second rotatable coupling comprises a second cutout to allow said second lever to adjust said second rotational angle, a second shaft to translate said second lever adjustment to said second heating tip, a second spacer to space said second handle from said second heating tip, and a second attachment to attach said second shaft to said second heating tip.

19. The curling iron of claim 17, wherein said second rotational angle is an angle in a range of between 0 degrees and 180 degrees.

20. The curling iron of claim 1, wherein said first rotatable coupling further comprises a first demountable coupling to attach and release said first heating tip to and from said first handle, and wherein said second coupling further comprises a second demountable coupling to attach and release said second heating tip to and from said second handle.

21. The curling iron of claim 20, wherein said curling iron further comprises at least one different length third heating tip to attach to and release from said first handle at said first demountable coupling, and at least one different length fourth heating tip to attach to and release from said second handle at said second demountable coupling.

22. A method comprising:

heating a first heating element to heat a first heating tip of a curling iron;

heating a second heating element to heat a second heating tip of a curling iron;

separating said first heating tip from said second heating tip;

curling a portion of hair by pressing said first heating tip towards said second heating tip to form a first contact surface;

separating said first heating tip from said second heating tip;

rotating said first heating tip 180 degrees around a first rotational axis lengthwise along said first heating tip to rotate said first heating tip second towards said second heating tip; and curling a portion of hair by pressing said first heating tip towards said second heating tip to form a second contact surface, wherein said second contact surface comprises a surface defined by contact between said first heating tip and said second heating tip.

23. The method of claim 22, wherein the first heating tip further comprises a generally oval shaped cross-section formed by joining a first generally convex curve with a second different generally convex curve, and wherein said second heating tip further comprises a generally crescent shaped cross-section formed by a generally circular curve intersected with a generally concave curve;

wherein said first contact surface comprises a surface defined by contact between said first heating tip first generally convex curve and said second heating tip generally concave curve;

wherein said rotating said first heating tip comprises rotating said first heating tip second different generally convex curve towards said second heating tip; and wherein said second contact surface comprises a surface defined by contact between said first heating tip second different generally convex curve and said second heating tip generally concave curve.

24. A method comprising:

heating a first heating element to heat a first heating tip of a curling iron;

heating a second heating element to heat a second heating tip of a curling iron;

pivoting said first heating tip away from said second heating tip to separate said first heating tip from said second heating tip;

curling a portion of hair by pivoting a first handle rotatably coupled to said first heating tip towards a second handle rotatably coupled to said second heating tip to cause said first heating tip to press the portion of hair into said second heating tip to form a first contact surface;

pivoting said first heating tip away from said second heating tip to separate said first heating tip from said second heating tip;

adjusting a first lever at said first handle to rotate said first heating tip 180 degrees around a first rotational axis lengthwise along said first handle to rotate said first heating tip towards said second heating tip;

adjusting a second lever at said second handle to rotate said second heating tip 180 degrees around a second rotational axis lengthwise along said second handle to rotate said second heating tip towards said first heating tip; and flattening a portion of hair by pivoting a first handle rotatably coupled to said first heating tip towards a second handle rotatably coupled to said second heating tip to cause said first heating tip to press the portion of hair into said second heating tip to form a second contact surface, wherein said second contact surface comprises a surface defined by contact between said first heating tip and said second heating tip.

25. The method of claim 24, wherein the first heating tip further comprises a generally oval shaped cross-section formed by joining a first generally convex curve with a second different generally convex curve and a first generally flat cross-sectional shape opposite from said first generally convex curve, and wherein said second heating tip further comprises a generally crescent shaped cross-section formed by a generally circular curve intersected with a generally concave curve and a second generally flat cross-sectional shape opposite from said generally concave curve;

wherein said first contact surface comprises a surface defined by contact between said first heating tip first generally convex curve and said second heating tip generally concave curve;

wherein said adjusting said first lever at said first handle comprises rotating said first generally flat cross-sectional shape towards said second heating tip;

wherein said adjusting said second lever at said second handle comprises rotating said second generally flat cross-sectional shape towards said first heating tip; and wherein said second contact surface comprises a surface defined by contact between said first generally flat cross-sectional shape and said second generally flat cross-sectional shape.

* * * * *